United States Patent [19]

Croser

[11] Patent Number: 4,467,846

[45] Date of Patent: Aug. 28, 1984

[54] BOTTLE FILLING DEVICE

[75] Inventor: Brian J. Croser, Piccadilly, Australia

[73] Assignee: Oenotec Pty. Limited, Unley, Australia

[21] Appl. No.: 405,090

[22] Filed: Aug. 4, 1982

[30] Foreign Application Priority Data

Aug. 12, 1981 [AU] Australia ..... PF0187/81

[51] Int. Cl.[3] ..... B65B 31/04

[52] U.S. Cl. ..... 141/47; 141/148; 141/275; 141/285; 141/353

[58] Field of Search ..... 141/4–9, 141/41, 37, 44, 47–50, 55, 57, 58, 62, 59–61, 63, 254, 255, 263, 264, 270, 276, 289, 351–357, 368, 392; 53/272, 276, 278, 279, 510; 222/148; 137/625.11

[56] References Cited

U.S. PATENT DOCUMENTS

| | | | |
|---|---|---|---|
| 2,239,364 | 4/1941 | Kantor | 141/47 |
| 2,261,705 | 11/1941 | Weaver | 141/47 |
| 2,363,543 | 11/1944 | De Haven Miller | 141/47 |
| 4,310,022 | 1/1982 | Cohen | 137/625.11 |

*Primary Examiner*—Stephen Marcus
*Assistant Examiner*—Kenneth S. Putnam
*Attorney, Agent, or Firm*—Michael J. Striker

[57] ABSTRACT

A bottle filling device which is intended to reduce oxidation of the liquid being filled by venting gas displaced from the bottle as filling occurs. If desired, the device can be used to fill bottles under a controlled atmosphere.

8 Claims, 4 Drawing Figures

BOTTLE FILLING DEVICE

The present invention consists in a bottle filling device and more particularly to a bottle filling device which is intended to reduce oxidation of the liquid being filled and which can if desired be used to fill bottles under a controlled atmosphere.

Some bottle filling devices comprise a reservoir of liquid having on its underside a plurality of filling heads. The raising of a bottle neck into sealing relationship with the underside of the filling head causes the filling head to open and discharge liquid into the bottle. As the liquid is run into the bottle the gas, whether air or an inert gas, in the bottle is displaced and normally passes out through a venting tube in the filling head. The flow of liquid into the bottle when the liquid has passed the underside of the venting tube, thereby preventing the escape of further gas from the bottle, and the pressure of gas in the neck of the bottle equals the pressure created by the head of liquid in the reservoir. In these filling devices removal of the bottle from the filling head closes the filling head leaving an amount of liquid trapped in the venting tube. In order for the venting tube to operate correctly for successive filling operations the liquid therein must be removed. Conventionally this is done by operating the reservoir under a slight vacuum and discharging the venting tube into the reservoir. This causes the liquid in the venting tube to be drawn back into the reservoir when the bottle is removed from the filling head.

If the liquid being bottled is susceptible to oxidation the conventional bottling device described above has disadvantages. Wine is a liquid susceptible to oxidation and it has been found that when wine, particularly high quality wine, is bottled using a device of the above type excessive oxidation can occur due to the mixture of the wine with air as the wine is being sucked up the venting tube into the reservoir. It has also been found that when the reservoir is operated under a slight vacuum, as is necessary to remove the wine from the venting tube, air is drawn into the reservoir through any imperfect seals in the filling heads or between the filling heads and the reservoir. This air will bubble through the wine in the reservoir with deleterious results for the wine quality.

The present invention provides means for filling bottles which reduces the possibility of oxidation of the liquid being filled into the bottles.

The present invention consists in a bottle filling device comprising a rotatable liquid reservoir, a plurality of filling heads connected to the base of the reservoir and rotatable therewith to each move between first and second filling stations, each filling head being engageable with a bottle at the first filling station, and disengageable therewith at the second filling station, each filling head having a first tube terminating below the level of the liquid in the reservoir and a second tube extending above the level of the liquid in the reservoir, valve means at the lower ends of the first and second tubes adapted to open the first and second tubes at or after the first filling station and to close them at or before the second filling station, and gas introduction means adapted to force a blast of gas down the second tube at the first filling station or intermediate the first and second filling stations to remove any liquid therefrom and to allow gas displaced by the filling of the bottle to be vented upwardly through the second tube until the liquid in the bottle rises to the level of the lower end of the second tube.

As used in this specification the expression "bottle" is taken to mean any rigid container having a suitable aperture for entering into sealing engagement with the filling head of the device.

The filling heads of the device are usually contacted with the bottles by introducing the bottles onto a rotating platform coaxial with the reservoir. The platform is preferably provided with a lifting device beneath each filling head which raises a bottle placed beneath the filling head into engagement therewith.

For convenience of construction it is preferable that the first tube surround the second tube. In this way liquid can flow from the reservoir down the annulus between the two tubes and into the bottle while the gas in the bottle is discharged through the inner, second, tube.

Any suitable arrangement of valves may be used to open and close the lower ends of the first and second tubes. This is, however, preferably achieved by causing one tube to rise relative to the other as the bottle is caused to bear against the filling head and to thereby open the valve means. In one particularly preferred embodiment of the invention the inner tube is closed at its tip by a closure member having a flange extending outwardly of the tube and holes are formed in the side wall of the tube slightly above the flange. An annular sealing member is slidably mounted on the inner tube and is lightly spring biassed away from the flange. The outer tube is heavily spring biassed into contact with the sealing member such that when the valves are closed it forces the sealing member down against the flange. The sealing member thereby closes off the lower end of both tubes simultaneously. If the outer tube is raised free of the sealing member the latter is then free to rise up from the flange. Liquid can then flow downwardly from the outer tube while gas can rise upwardly into the inner tube through the holes in the sidewall thereof.

The gas introduction means may be any means adapted to force a blast of gas down the second tube to discharge liquid therefrom. The gas blast preferably takes place as, or soon after, the lower end of the second tube is opened. In one preferred embodiment of the invention a stationary gas distribution head is positioned above the path of the filling heads as they rotate with the liquid reservoir. As each second tube comes into juxtaposition with the gas distribution head a blast of gas is discharged down the tube. In this arrangement when the second tube is not beneath the gas distribution head and while the valve means controlling the lower end of the second tube is open gas may freely pass up the second tube into the atmosphere above the liquid within the reservoir.

It is preferred that the gas used in the gas blast is an inert gas such as carbon dioxide or nitrogen. If such a gas is used it has the advantage that the liquid blasted out of a tube into a bottle will not be subject to as much oxidation as would otherwise be the case. As the gas distribution head has to be arranged to sequentially deliver gas to a plurality of second tubes there will inevitably be some leakage of inert gas into the atmosphere above the liquid in the reservoir. This is to be encouraged as it reduces, or in some cases substantially eliminates, the oxygen content of the atmosphere above the liquid and this reduces oxidation of the liquid. It also ensures a slight overpressure above the liquid which will prevent air being drawn into the reservoir through leaky seals; a corollary of this is, of course, that if there are imperfect seals between the filling heads and the bowl. some liquid will instead seep out through such seals and this seepage will indicate the need to tighten or replace these seals.

Hereinafter given by way of example only is a preferred embodiment of the present invention described with reference to the accompanying drawings in which.

Figure 1:
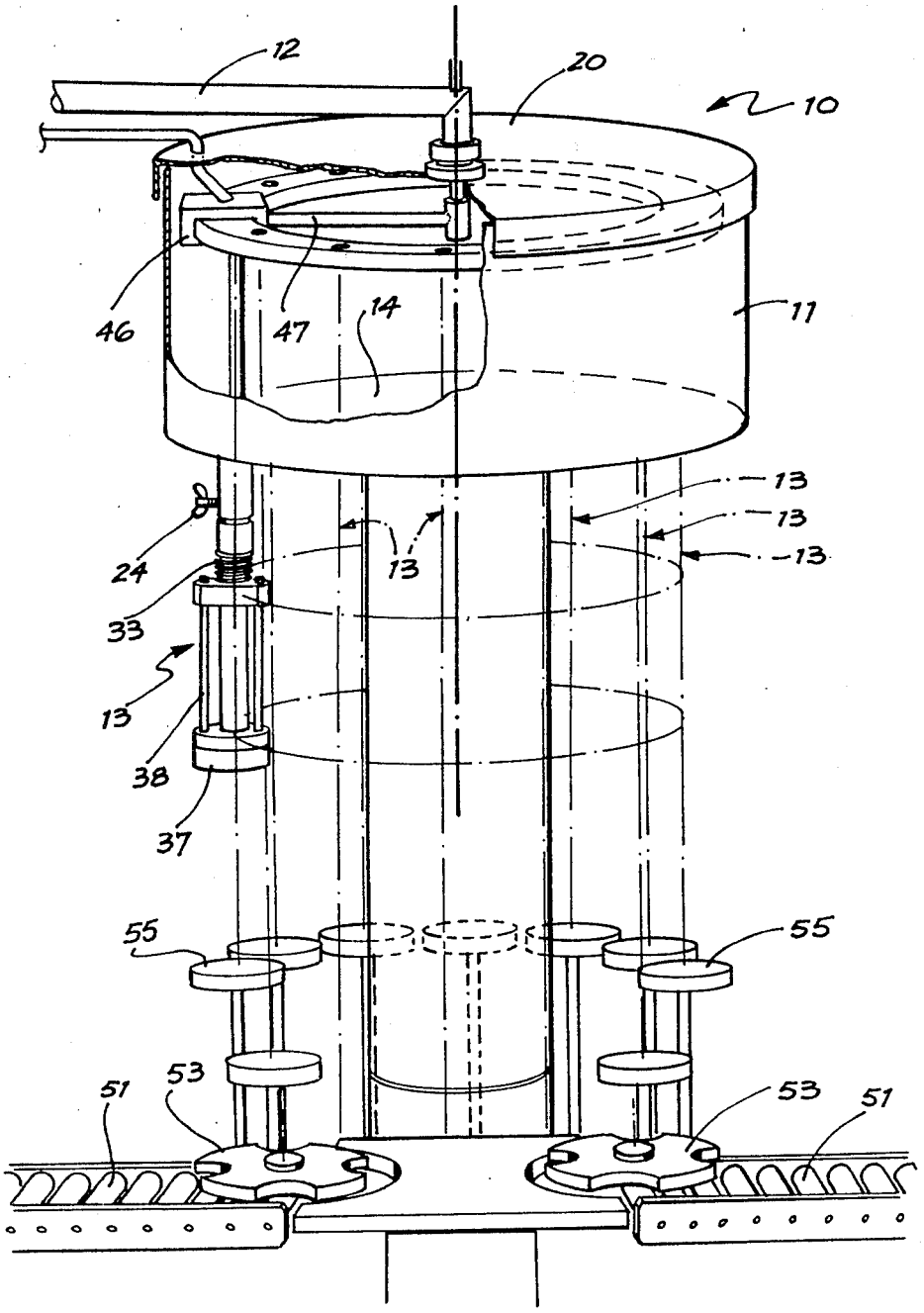
FIG. 1 is a partly cut away perspective view of a bottle filling device according of this invention.

The bottle filling device 10 comprises a bowl-like reservoir 11 having a tightly fitting but not gas-tight lid 20. The reservoir 11 is mounted to be rotated in a horizontal plane. A wine introduction pipe 12 extends through the lid 20 and is supported by means which are conventional in the art. A plurality of filling heads 13 are arranged in the base 14 of the reservoir 11. These filling heads 13 are arranged in a circular array all being equidistant from the wine introduction pipe 12.

Each filling head 13 includes an inner tube 15 which at its upper end fits into a guide block 16 which is connected to the underside of a planar and annular plate 17. A bore 18 extends vertically through the annular plate 17 and communicates with the bore of the tube 15. The annular plate 17 is maintained in a horizontal disposition within the reservoir 11 and above the level of the liquid in the reservoir (shown by line 19) by the full array of second tubes 15.

Each filling head further includes a tube 21 screwed into the base 14 of the reservoir 11 and into the lower end of which in turn is screwed a collar 22. The collar 22 includes a first bore 23 through which the inner tube 15 extends. The inner tube 15 is fixed in relation to collar 22 by a radially extending wing bolt 24 which is disposed in a threaded radially extending hole 25 in the collar 22. The wing bolt 24 bears against the wall of tube 15 and clamps it in place. A further bore 26 extends vertically through collar 22 parallel to bore 23.

The lower end of collar 22 is formed integrally with vertical sleeve 27. A collar 28 is slidably disposed within sleeve 27. Suitable O-rings 29 and 31 are disposed about collar 28 to form a liquid tight seal between collar 28 and sleeve 27. The collar 28 extends beyond the end of sleeve 27 and is surrounded by and connected to block 32. A compression spring 33 surrounds the lower end of sleeve 27 and bears at its upper end on a downwardly facing shoulder 34 on sleeve 27 and at its lower end on block 32 to thereby downwardly bias block 32, and collar 28 connected to it. The upper end of a tube 35 is connected inside the collar 28. The tube 35 defines an annular passage 36 surrounding tube 15.

A filling bell 37 of conventional type is slidably disposed about tube 35. Vertical rods 38 on the bell extend through bores 39 in block 32. An O-ring 41 on the upper end of each of the rods 38 limits downward movement of the bell 37 on tube 35.

Figure 3:
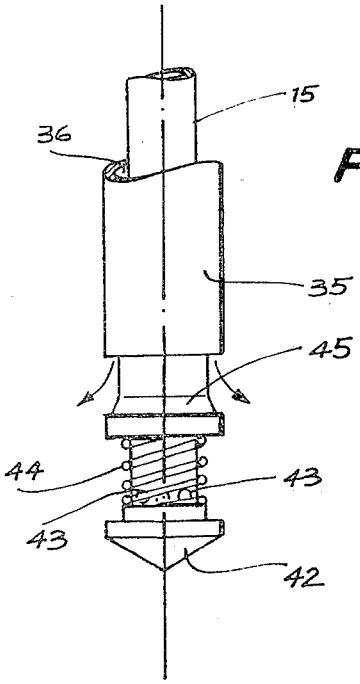
FIG. 3 is a partly cut away view of an enlarged scale of the lower end of the inner and outer tubes of FIG. 1 in an open configuration.
Figure 4:
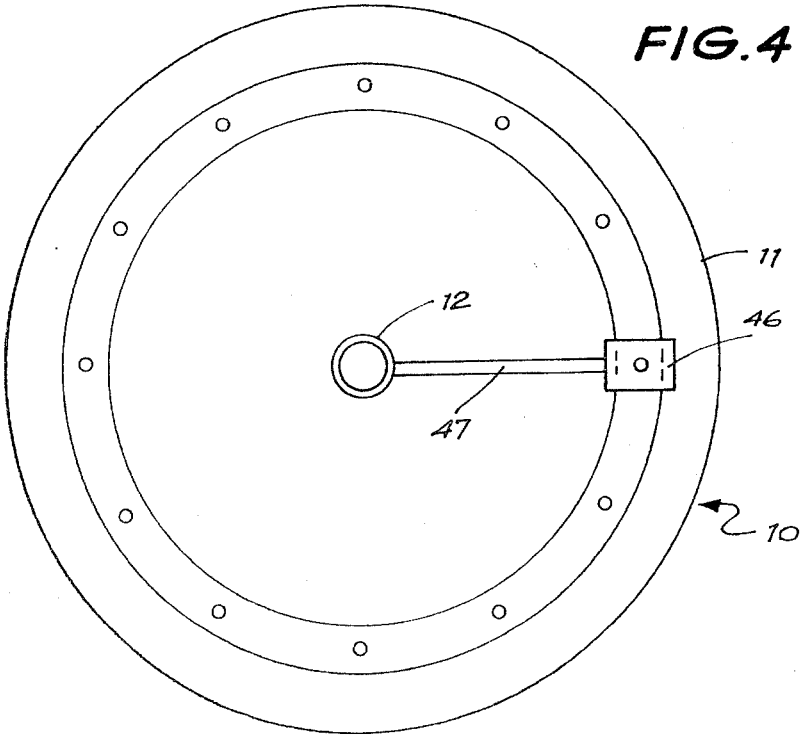
FIG. 4 is a plan view of the bottle filling device of the present invention with the lid of the reservoir removed.

The lower end of tube 15 is formed (as is best seen in FIG. 3) with a tip 42 which closes the end of tube 15 and extends outwardly to form an annular flange. The tube 15 is formed above the tip 42 with a plurality of radial holes 43. A spring 44 surrounds the tube 15 and rests on the flange formed by tip 42. An annular sealing member 45 formed of nylon, teflon or a like material surrounds the tube 15 and is freely slidable thereon. The underside of the sealing member is smoothed such that when it is pressed downwardly relative to the tube 15 is enters into a sealing engagement with the tip 42. The upper surface of the sealing member 45 is also chamfered to allow it to enter into sealing engagement with the lower end of tube 35 or a rubber or like material O-ring is fitted to the upper surface to bring about sealing between the two surfaces.

Figure 2:
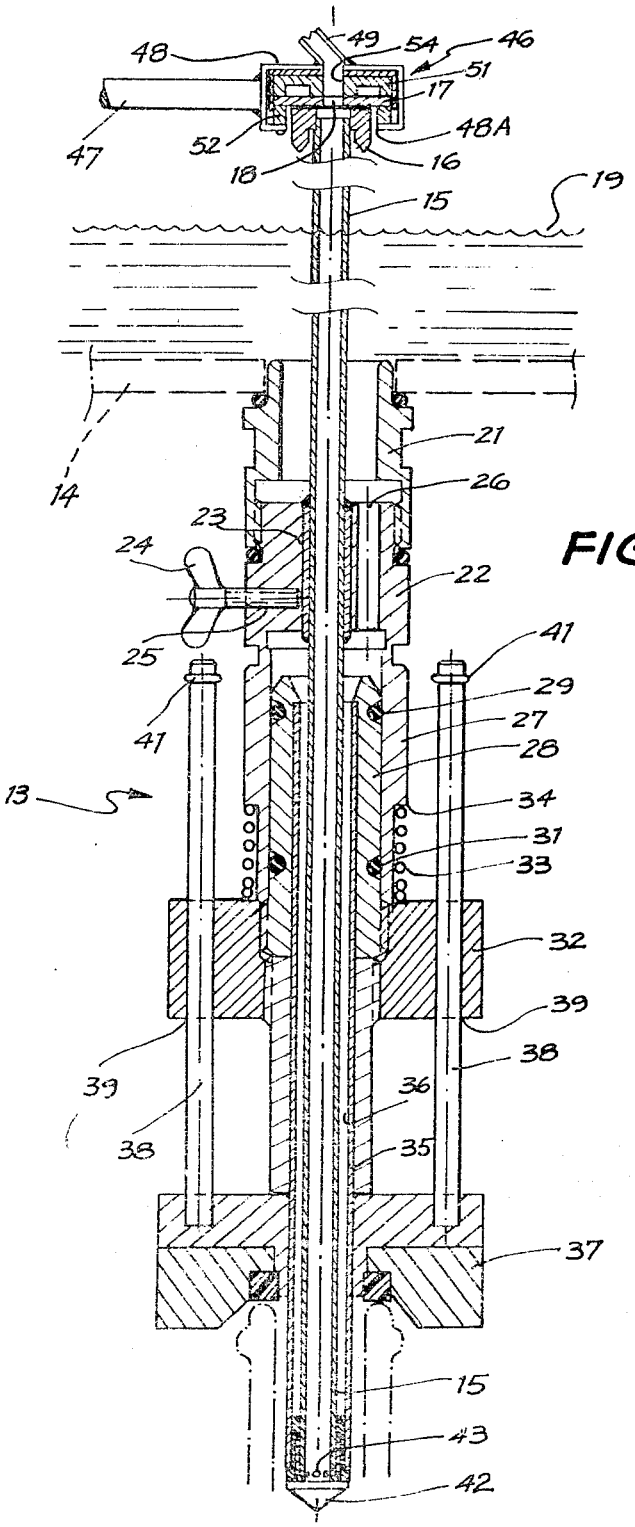
FIG. 2 is a cross sectional view through a filling head of the bottle filling device of FIG. 1.

A gas distribution head 46 rests on the annular plate 17 and is held stationary relative thereto by an arm 47 connecting the head 46 to the post 12. The gas distribution head 46 (as is best seen in FIG. 2) comprises an inverted U-shaped plate 48 of stainless steel to which is welded a gas inlet tube 49. Guide blocks 51 of teflon, nylon or like material are disposed between the base of the U-shaped plate 48 and the upper surface of the annular plate 17. Similar guide blocks 52 are disposed between the inturned free edges 48A of the plate 48 and the underside of the plate 17. A bore 54 extends through the guide blocks 51 and communicates with the gas inlet tube 49.

In use the reservoir 11 is rotated continuously and bottles are introduced sequentially to filling heads as they pass a first position during each revolution of the reservoir. Such bottles are moved along a conveyor 51 and are individually placed on bottle supports 55 by a rotating guide plate 53. The supports 55 rotate with the bottle filling heads 13 and are raised and lowered to bring the bottles into contact with a corresponding one of the filling heads 13. As the bottle neck contacts the bell 37 it causes it to rise until it strikes the block 32. Further upward movement of the bottle raises the block 32 and with it collar 28 and tube 35. The upward movement of tube 35 allows the annular sealing member 45 to be raised by spring 44 thereby revealing holes 43. Still further upward movement of the bottle raises the block 32 until the collar 28 strikes the collar 22, at this point the lower end of tube 35 will be raised above the annular sealing member and both tubes 15 and 35 will be in communication with the inside of the bottle.

The gas distribution head 46 is so disposed that it will be directly above tube 15 just as its lower end is opened as described above. A blast of gas will thus travel down tube 15 and blow out into the bottle through holes 43 any liquid left in the tube 15 from a previous filling operation.

Upon the tube 35 rising above the annular sealing member 45 as described above the liquid in the reservoir 11 is free to run into the bottle through tube 21, bore 26, and the annular passage 36 defined by tube 35.

The rotation of the reservoir 11 will carry tube 15 past the gas filling head 46 as liquid is running into the bottle through tube 35. The tube 15 will then be free to act as a vent tube to carry gas displaced by the incoming liquid out of the bottle into the reservoir 11 above the liquid level 19. The liquid will flow into the bottle through tube 35 rising past holes 43 and will continue until the gas pressure in the neck of the bottle equals the head pressure of the liquid into the reservoir.

Removal of the bottle from the filling head 13 after the bottle has been filled allows the tube 35 to move downwardly under the force of spring 33 thereby shutting off the lower ends of tubes 15 and 35. A small amount of liquid will be thereby trapped in tube 15 and it is this liquid which will be removed by the next blast of gas from distribution head 46.

I claim:

1. A bottle filling device comprising a rotatable liquid reservoir, a plurality of filling heads connected to the base of the reservoir and rotatable therewith to each move between first and second filling stations, each filling head being engageable with a bottle at the first filling station, and disengagable therewith at the second filling station, each filling head having a first tube terminating below the level of the liquid in the reservoir and a second tube extending above the level of the liquid in the reservoir, valve means at the lower ends of the first and second tubes adapted to open the first and second tubes at or after the first filling station and to close them at or before the second filling station, and gas introduction means adapted to force a blast of gas down the second tube at the first filling station or intermediate the first and second filling stations to remove any liquid therefrom and to allow gas displaced by the filling of the bottle to be vented upwardly through the second tube until the liquid in the bottle rises to the level of the lower end of the second tube, each of said second tubes having an upper end that opens into a planar annular ring which is adapted to rotate with the filling heads, and said gas introduction means having a stationary gas distribution head resting on said ring and adapted to introduce a gas charge into each of said second tubes as it passes beneath the gas distribution head.

2. A bottle filling device as claimed in claim 1 in which the valve means is opened by the bringing of a bottle into contact with a filling head at the first station and by the withdrawal of the bottle at the second station.

3. A bottle filling device as claimed in claim 3 in which the second tube is disposed within the first tube.

4. A bottle filling device as claimed in claim 3 in which the second tube is closed at its lower end by a flanged member and has apertures in its side wall above the flanged member, and in which the valve means comprises spring means urging the end of the first tube into sealing engagement with the flanged member.

5. A bottle filling device as claimed in claim 4 in which an annular sealing member is slidably disposed about the second tube and sealingly engages the end of the first tube and the flanged member, the annular sealing member being spring biassed away from the flanged member by a spring weaker than that urging the first tube towards the flanged member.

6. A bottle filling device as claimed in claim 1 in which the gas distributed through the gas introductory means is inert gas.

7. A bottle filling device as claimed in claim 6, in which the inert gas distributed through the gas introduction means is carbon dioxide.

8. A bottle filling device as claimed in claim 6, in which the inert gas distributed through the gas introduction means is nitrogen.

* * * * *